US009161635B2

(12) United States Patent
Toribuchi et al.

(10) Patent No.: US 9,161,635 B2
(45) Date of Patent: Oct. 20, 2015

(54) SHEET FASTENER

(75) Inventors: Yoshito Toribuchi, Tokyo (JP); Tetsuya Yoshino, Tokyo (JP); Hiroshi Ishisaka, Toyama (JP); Masahiro Ujihara, Wuppertal (DE); Takahiro Usui, Tokyo (JP)

(73) Assignees: YKK Corporation (JP); Toyota Boshoku Corporation (JP)

( * ) Notice: Subject to any disclaimer, the term of this patent is extended or adjusted under 35 U.S.C. 154(b) by 0 days.

(21) Appl. No.: 14/348,928

(22) PCT Filed: Oct. 6, 2011

(86) PCT No.: PCT/JP2011/073068

§ 371 (c)(1),
(2), (4) Date: Apr. 1, 2014

(87) PCT Pub. No.: WO2013/051124

PCT Pub. Date: Apr. 11, 2013

(65) Prior Publication Data

US 2015/0047158 A1 Feb. 19, 2015

(51) Int. Cl.
*A47C 31/02* (2006.01)
*B68G 7/12* (2006.01)

(52) U.S. Cl.
CPC ..... *A47C 31/023* (2013.01); *B68G 7/12* (2013.01)

(58) Field of Classification Search
USPC ..... 24/700–702, 30.5 L, 456, 460; 297/218.1, 218.4, 228.13, 218.5; 5/402, 403
See application file for complete search history.

(56) References Cited

U.S. PATENT DOCUMENTS

| | | | | | |
|---|---|---|---|---|---|
| 2,784,781 | A | * | 3/1957 | Rhoades | 160/371 |
| 3,803,671 | A | * | 4/1974 | Stuppy et al. | 24/460 |
| 3,904,242 | A | * | 9/1975 | Koepke et al. | 297/452.6 |
| 3,981,534 | A | * | 9/1976 | Wilton | 297/218.1 |
| 4,153,981 | A | * | 5/1979 | Stuppy | 24/456 |
| 4,662,038 | A | * | 5/1987 | Walker | 24/460 |
| 5,879,051 | A | * | 3/1999 | Cozzani | 297/218.3 |

(Continued)

FOREIGN PATENT DOCUMENTS

| | | |
|---|---|---|
| DE | 10 2007 059454 A1 | 6/2009 |
| JP | S55-23151 U | 2/1980 |

(Continued)

OTHER PUBLICATIONS

International Preliminary Report on Patentability, PCT Application No. PCT/JP2011/073068, mailed Apr. 8, 2014.

(Continued)

*Primary Examiner* — Robert J Sandy
*Assistant Examiner* — Rowland Do
(74) *Attorney, Agent, or Firm* — Kilpatrick Townsend & Stockton LLP

(57) ABSTRACT

A first member includes a first fixing portion on which a sheet edge is fixed, a holder continuous with an end of the first fixing portion, a first recess that is defined in the holder and has an opening in a continuous direction of the first fixing portion, and a support portion that is formed opposite the first fixing portion across the opening of the first recess of the holder. A second member includes a second fixing portion on which the other sheet edge is fixed, a held portion continuous with an end of the second fixing portion. When the held portion is inserted into the first recess, the support portion is brought into contact with a surface of the second fixing portion.

4 Claims, 12 Drawing Sheets

(56) References Cited

U.S. PATENT DOCUMENTS

| | | | | |
|---|---|---|---|---|
| 8,157,324 | B2 * | 4/2012 | Matsuzaki et al. | 297/218.1 |
| 8,733,834 | B2 * | 5/2014 | Palmer | 297/218.5 |
| 2010/0259079 | A1 | 10/2010 | Matsuzaki et al. | |
| 2013/0175834 | A1 * | 7/2013 | Hennig et al. | 297/218.1 |

FOREIGN PATENT DOCUMENTS

| | | | |
|---|---|---|---|
| JP | S62 102499 | U | 6/1987 |
| JP | 2-195985 | A | 8/1990 |
| JP | 6-277373 | A | 10/1994 |
| JP | 2004-242934 | A | 9/2004 |
| JP | 2006-218115 | A | 8/2006 |
| JP | 2007-37703 | A | 2/2007 |
| WO | 2008/099757 | A1 | 8/2008 |

OTHER PUBLICATIONS

International Search Report, PCT Application No. PCT/JP2011/073068 mailed Nov. 22, 2011.

Supplementary European Search Report, European Patent Application No. 11873767.5, mailed Apr. 23, 2015.

* cited by examiner

SHEET FASTENER

This application is a national stage application of PCT/JP2011/073068, which is incorporated herein by reference.

TECHNICAL FIELD

The present invention relates to a sheet fastener for fastening overlaid edges of a covering material, more specifically, a tool used to secure the edges of the covering material such as a top cover for a vehicle seat, a top cover for furniture and a cover for a package during transportation.

BACKGROUND ART

A sheet fastener has been typically used for fastening overlaid edges of a covering material.

For instance, a seat surface, a back surface, a headrest, an armrest and the like of a vehicle seat are finished with a cushion material such as a synthetic resin foam (base material) and a sheet-like top cover (covering material) over a surface of the cushion material. The top cover is three-dimensionally sewn in advance in a manner to fit to an outer shape of the cushion material. The top cover is put over the cushion material through a partly remaining opening of the top cover and is finished by lastly closing the opening. With this arrangement, a seam line and the like are unlikely to be exposed, thereby ensuring an excellent appearance. The opening is lastly closed by fastening the overlaid edges of the top cover using a sheet fastener made of a continuous molding material, thereby enhancing the appearance.

Such a sheet fastener is applicable to, in addition to a seat of a vehicle such as an automobile and a train, a seat of an airplane and a ship, a seat used at school and office, a cushion of sports gears and furniture such as a sofa and a bed for residence and medical care.

Moreover, in addition to the top cover such as the seat and the cushion, the sheet fastener is also applicable for fastening sheet edges of a structural object such as a tent, fastening cover edges of a package during transportation, and the like.

As a specific arrangement of such a sheet fastener, arrangements described in Patent Literatures 1 and 2 are known.

A sheet fastener of Patent Literature 1 includes a first member and a second member, each of which is a continuous member made of a synthetic resin by extrusion molding. The second member includes a U-shape part in cross section. A sheet edge is fixed to an end of the U-shape part while a bead is provided at the other end thereof. The first member is formed to have a U-shape part similar to the second member in an inverse direction.

When edges of a pair of sheets are fastened with the above fastener, the second member is pulled to a position where the first member is covered with the sheet. While openings of the U-shape parts of the first member and the second member face each other, the bead of the second member is inserted into the first member, where tension of the sheet of each of the first member and the second member works so that the first and second members respectively go into the innermost parts of the mutually facing U-shape parts thereof, thereby maintaining mutual engagement.

The sheet fastener of Patent Literature 2 includes a first member and a second member to which a sheet edge is fixed. The second member is formed in a plate having bulging ends and a bendable intermediate. The sheet edge is fixed to a base end of the second member. The first member includes a U-shape part in cross section, into which an end of the second member can be inserted and engaged.

When edges of a pair of sheets are fastened with the above fastener, the edge of one of the sheets is initially fixed to a base end of the second member. Then, the second member is rotated and a tip end thereof is inserted into the first member, so that the first member and the second member are engaged. At this time, while the sheet edge is wound around the base end of the second member, the intermediate of the second member is bent, so that the U-shape part of the first member can be covered.

CITATION LIST

Patent Literature

Patent Literature 1 JP-UM-A-55-23151
Patent Literature 2 JP-A-2007-37703

SUMMARY OF THE INVENTION

Problems to be Solved by the Invention

In the fastener disclosed in Patent Literature 1, when the first and second members are engaged, a pair of sheets are pulled closer to each other, thereby temporarily increasing the tension of the sheets. However, in an engaging state of the first and second member, the tension becomes relaxed.

With such tension relaxation, the sheets are occasionally creased or like, which is not favorable as a top cover for covering, for instance, a cushion.

In the fastener disclosed in Patent Literature 2, for the engagement, the second member is rotated around the first member to apply tension to the sheet, whereby the tension of the sheet can be kept even after the engagement, thereby avoiding generation of creases or the like of the sheet.

However, the arrangement of Patent Literature 2 requires an operation of rotating the second member so as to insert the second member into the first member while pulling the second member in order to apply the tension on the sheet. Moreover, a composite operation of pulling and rotating are required over a total length of the edge of the sheet. Thus, the operation is complex and inefficient.

Further, in the arrangement of Patent Literature 2, since the sheet edge wound around the second member is kept in non-contact with the first member, when the tension is applied on the edge of the sheet, the sheet is deformed to generate a gap, resulting in an unfavorable appearance.

An object of the invention is to provide a sheet fastener capable of securing tension of a sheet and improving an operation efficiency.

Means for Solving the Problems

According to an aspect of the invention, a sheet fastener for fastening a pair of sheet edges continuously along the sheet edges includes: a first member; and a second member to be inserted into the first member, each of the first member and the second member being provided by a continuous member having a predetermined cross section, in which the first member includes s a first fixing portion on which one of the sheet edges is fixed and a holder continuous with the first fixing portion, the holder includes a first recess and a support portion formed opposite the first fixing portion across an opening of the first recess, the second member includes a second fixing portion on which the other of the sheet edges is fixed and a head continuous with the second fixing portion, and the support portion is configured to be brought into contact with a surface of the second fixing portion when the head of the second member is inserted into the first recess of the first member.

In the above aspect of the invention, one of the sheet edges is fixed to the first fixing portion of the first member while the other of the sheet edges is fixed to the second fixing portion of the second member. A pair of sheet edges are fastened by mutually connecting the first member and the second member.

When the first member and the second member are connected, the head of the second member is initially moved closer to the first member so that the second member is situated substantially perpendicular to the first member. The support portion of the first member supports a part between the head and the second fixing portion of the second member. (Temporary Holding State)

Next, the second member is rotated around the support portion to move the head of the second member into the first recess and to rotate the second fixing portion, thereby winding the sheet edge around the second fixing portion. By keeping the rotation of the second member, tension is applied on the sheet edge and the second member becomes more parallel to the first member, whereby the head of the second member is inserted into the first recess. Finally, the support portion is brought into contact with a surface of the second fixing portion and the head is brought into contact with a part of an inner surface of the first recess.

By this contact at the two points, the first member and the second member are in mutual engagement (Full Holding State).

Thus, in the above aspect of the invention, for connecting the first member and the second member, the first member and the second member can be held in the temporary holding state and the full holding state. When the sheet edges are neatly arranged for mutual fastening before the temporary holding state, and the tension is applied on the sheet edges in a process from the temporary holding state before the full holding state, a requisite tension enough to fasten the sheet is obtainable while the tension is applicable on the neatly arranged sheet.

Since the tension is applied using the rotation of the second member, an operator does not need an operation such as twisting of his wrist, so that an efficient operation is possible. Moreover, since the first member and the second member are brought into the temporary holding state before the tension is applied, there is enough time to neatly arrange the sheet along the whole length of the sheet edges. In other words, after the first member and the second member are initially brought into the temporary holding state along the whole length of the sheet edges and the whole sheet are neatly arranged, the second member is rotated along the whole length of sheet edges, whereby the first member and the second member can be brought into the full holding state.

With this arrangement, a sheet fastener capable of ensuring the tension of the sheet and improving an operating efficiency can be obtained.

In the above aspect of the invention, preferably, the support portion and the head are configured such that the support portion is brought into contact with the surface of the second fixing portion and, simultaneously, the head is brought into contact with an inner surface of the first recess, when the head is inserted into the first recess.

With this arrangement, since the first member and the second member are in contact at two points in the aforementioned temporary holding state, a posture of each of the first member and the second member in the temporary holding state can be stably maintained.

In the above aspect of the invention, the head preferably includes a held portion continuous with the second fixing portion and a second recess that is defined in the held portion and includes an opening engageable with the support portion.

With this arrangement, in the aforementioned temporary holding state, the posture of each of the first member and the second member can be more stably maintained by inserting the support portion of the first member into the second recess of the second member.

In the above aspect of the invention, preferably, the second member includes a contact portion formed along an opening edge of the held portion near the second fixing portion, the contact portion and the support portion are configured such that the contact portion is brought into contact with a lateral surface of the support portion and, simultaneously, a tip end of the support portion is brought into contact with an inner surface of the held portion, when the support portion is inserted into the held portion, and the support portion is configured to be brought into contact with the surface of the second fixing portion when the held portion of the second member is inserted into the first recess.

With this arrangement, in the aforementioned temporary holding state, the contact portion of the second member is brought into contact with the lateral surface of the support portion of the first member while the tip end of the support portion is brought into contact with the innermost part of the second recess. By the contact at the two points, the first member and the second member are maintained in more stable conditions. Further, in the aforementioned full holding state, a posture of each of the first member and the second member in the full holding state can be stably maintained when the support portion is in contact with the surface of the second fixing portion.

In the above aspect of the invention, the first member preferably includes a projection that projects toward the support portion.

With this arrangement, during shifting from the temporary holding state to the full holding state, the second member can be pressed toward the support portion by the projection, thereby moving the support portion from the second recess through the contact portion to slide over the second fixing potion, so that the second member can be smoothly rotated.

In the above aspect of the invention, preferably, the projection projects from a connection part of the holder and the first fixing portion toward the support portion, and a gap between the projection and the support portion is defined to be smaller than a minimum thickness of the held portion of the second fixing portion in a thickness direction.

With this arrangement, a pressing effect by the projection can be secured.

Further, by forming a step or a striation on the surface of the second member with which the projection is brought into slide contact, a click feeling can also be obtained when the second member is rotated to reach the full holding state, so that improvement in operability can be expected.

Herein, the click feeling means a slight impact and vibration felt by a hand of the operator, or sound, which are generated by the projection moving over the above step or striation when the operator operates the first member and the second member. It can be easily and reliably confirmed by obtaining such a click feeling whether the operation is actually performed.

In the above aspect of the invention, preferably, the head is formed in a plate extending from an end of the second fixing portion in a direction intersecting therewith, and the second member has a T-shaped or L-shaped cross section as a whole, and a second recess having an opening engageable with the support portion is defined by an internal corner at an intersecting part of the second fixing portion and the head.

With this arrangement, the cross section of the second member as a whole can be T-shaped or L-shaped, resulting in a simplified structure.

DESCRIPTION OF EMBODIMENT(S)

Exemplary embodiment(s) of the invention will be described in detail below with reference to the attached drawings.

Overall Structure

Figure 1:
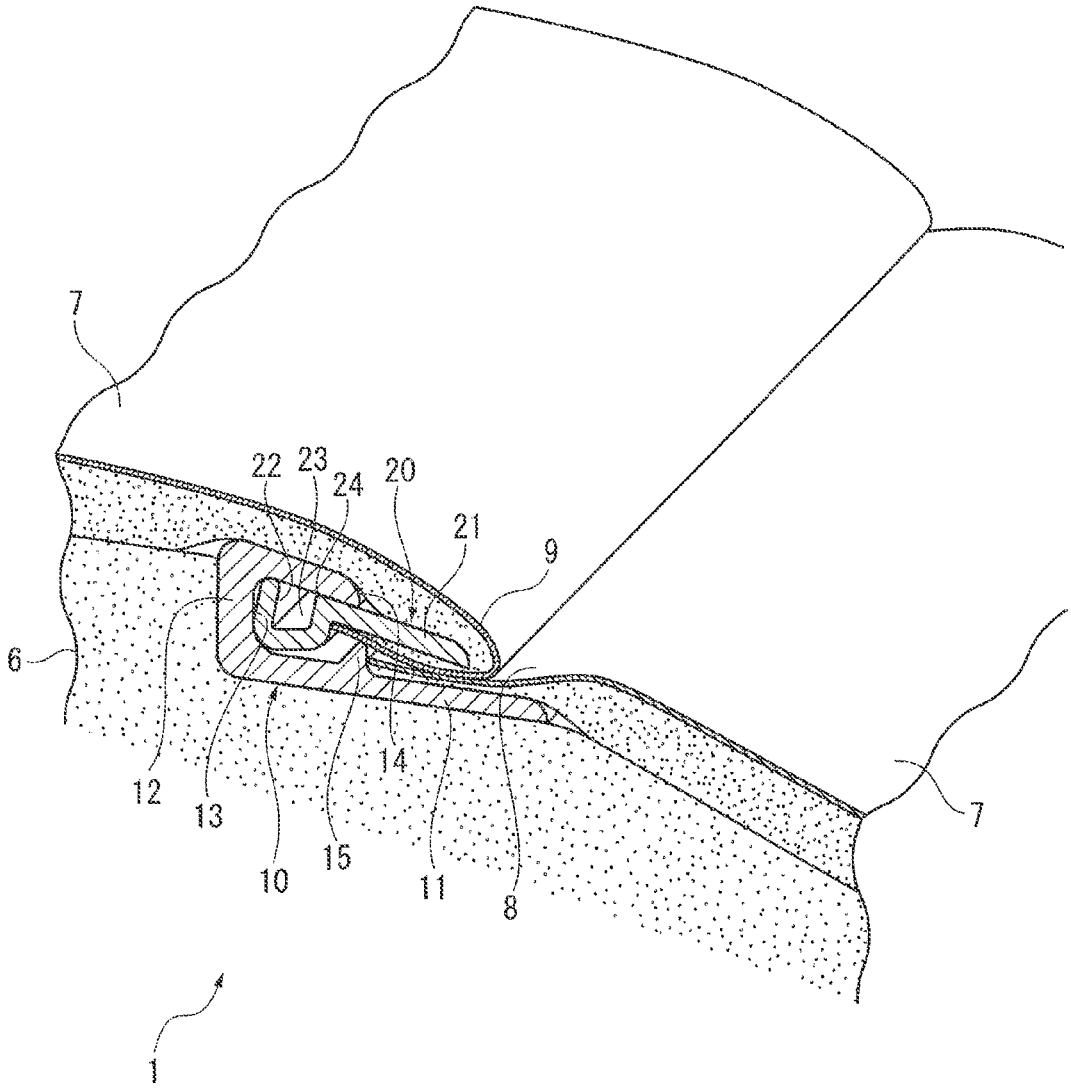
FIG. 1 is a partially-cutaway perspective view showing an exemplary embodiment of the invention.

In FIG. 1, a sheet fastener 1 according to the exemplary embodiment fastens a pair of sheet edges 8 and 9 continuously along a seam line when a surface of a cushion material 6 is covered with a sheet 7 (top cover). The sheet fastener 1 includes a first member 10 and a second member 20, each of which is a continuous member having a predetermined cross section and integrally formed of a synthetic resin material.

The first member 10 and the second member 20 each are a continuous member manufactured of a synthetic resin material by extrusion molding, injection molding and the like.

First Member

Figure 2:
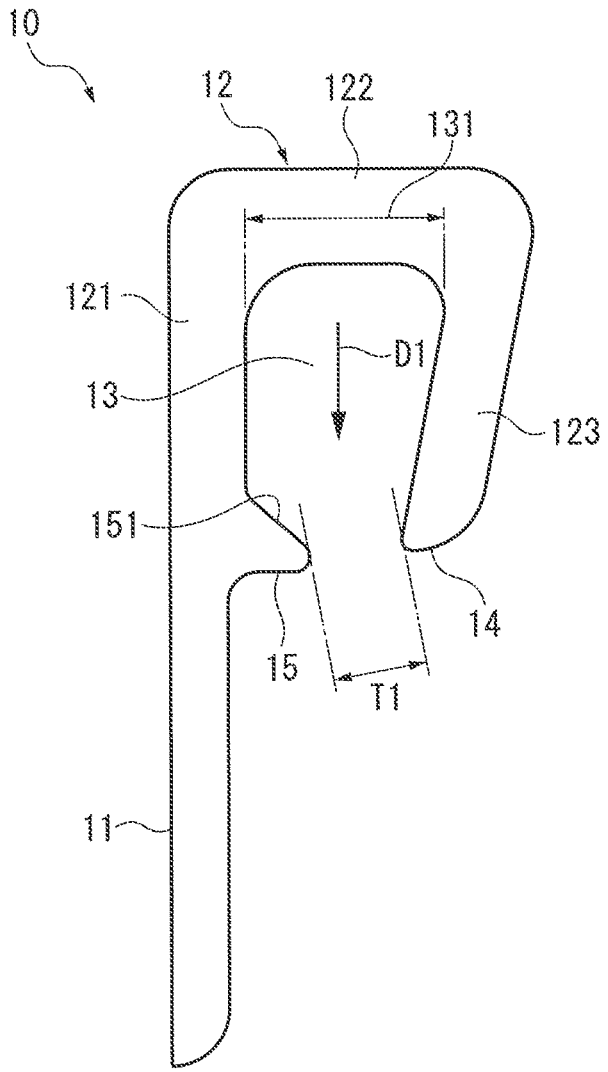
FIG. 2 is an end elevation showing a first member according to the above exemplary embodiment.

FIG. 2 shows a cross section of the first member 10 in the exemplary embodiment.

The first member 10 includes: a first fixing portion 11 on which the sheet edge 8 is fixed; a holder 12 that is continuous with an end of the first fixing portion 11; a first recess 13 that is defined in the holder 12 and is open in a continuous direction D1 of the first fixing portion 11; a support portion 14 that surrounds the first recess 13 of the holder 12 and is formed at an opposite end to the end continuous with the first fixing portion 11 of the holder 12 in a manner to be directed to an extending direction of the first fixing portion 11; and a projection 15 that projects from a connection part of the holder 12 and the first fixing portion 11 toward the support portion 14.

The holder 12 is formed substantially in a U-shape with three flat parts 121, 122 and 123 surrounding the first recess 13.

The first flat part 121 is a part continuous with the end of the first fixing portion 11 on which the sheet edge 8 is fixed, and is formed in an extension of the first fixing portion 11 along the continuous direction D1 of the first fixing portion 11.

The second flat part 122 is continuous with an end of the first flat part 121 which is opposite to an end thereof continuous with the first fixing portion 11 and extends in a direction orthogonal to the continuous direction D1 of the first flat part 121 and the first fixing portion 11.

The third flat part 123 is continuous with an end of the second flat part 122 which is opposite to the end of the second flat part 122 continuous with the flat part 121, and extends from the continuous end in an inverted manner such the holder 12 is formed in a C-shape. An inner surface of the third flat part 123 is positioned to face an inner surface of the first flat part 121. The support portion 14 is defined at an end of the third flat part 123. The third flat part 123 forms an acute angle relative to the second flat part 122 and is inclined such that the end (the support portion 14) of third flat part 123 approaches the first flat part 121 and the first fixing portion 11.

The support portion 14 at the end of the third flat part 123 is positioned to face the projection 15. A gap of a width T1 is created between the support portion 14 and the projection 15 to define an opening of the first recess 13.

The first recess 13 is formed substantially in a C-shape with the first to third flat parts 121 to 123. An inner surface of the first recess 13 is defined by inner surfaces of the first to third flat parts 121 to 123. Among the first to third flat parts 121 to 123, the second flat part 122 is farthest from the opening of the first recess 13. A part of the first recess 13 along the second flat part 122 is defined as an innermost part 131 of the first recess 13.

In addition to an inner surface along the second flat part 122, the innermost part 131 may include curve parts continuous with inner surfaces of the first and third flat parts 121 and 123.

Second Member

Figure 3:
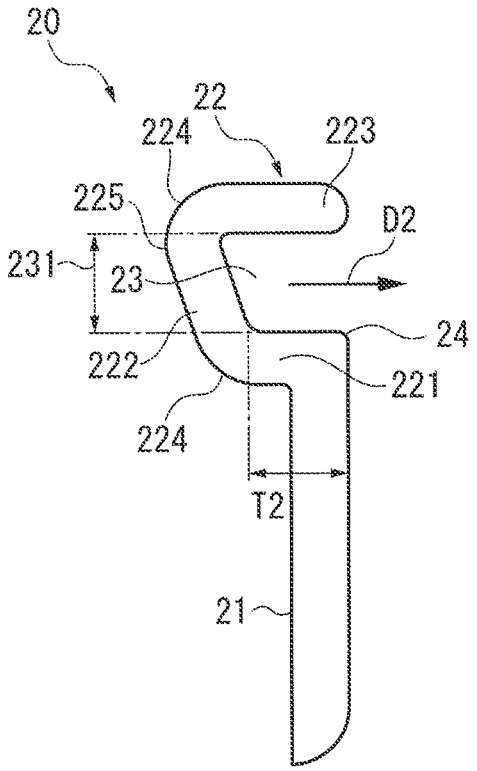
FIG. 3 is an end elevation showing a second member according to the above exemplary embodiment.

FIG. 3 shows a cross section of the second member 20 in the exemplary embodiment.

The second member 20 includes: a second fixing portion 21 on which a sheet edge 9 is fixed; a held portion 22 (head) that is continuous with an end of the second fixing portion 21; a second recess 23 that is defined in the held portion 22 and is open in a thickness direction D2 of the second fixing portion 21; and a contact portion 24 that is formed along an opening edge of the second recess 23 near the second fixing portion 21.

The held portion 22 is formed substantially in a C-shape with three flat portions 221, 222 and 223 surrounding the second recess 23.

The first flat portion 221 is a part continuous with the end of the second fixing portion 21 on which the sheet edge 9 is fixed, and extends in the thickness direction D2 of the second fixing portion 21, in other words, in a direction orthogonal to the continuous direction of the second fixing portion 21.

The second flat portion 222 is continuous with an end of the first flat portion 221 which is opposite to an end of the first flat portion 221 continuous with the second fixing portion 21 and extends in a direction intersecting with the continuous direction of the first flat portion 221.

The third flat portion 223 is continuous with an end of the second flat portion 222 which is opposite to an end of the second flat portion 222 continuous with the first flat part 221 and extends from the continuous end in an inverted manner such that the held portion 22 is formed in a C-shape. The third flat part 223 is in parallel to the first flat part 221 and is positioned such that an inner surface of the third flat part 223 faces an inner surface of the first flat part 221.

The second flat part 222 is connected to the first flat part 221 at an angle more than 90 degrees while being connected to the third flat part 223 at an angle less than 90 degrees, inside the second recess 23. Moreover, the second flat part 222 is also inclined relative to a continuous direction of the second fixing portion 21 such that the second flat part 222 continuous with the first flat part 221 approaches an extended axial line of the second fixing portion 21 or the contact portion 24.

An end of the third flat part 223 (an end opposite to an end of the third flat part 223 continuous with the second flat part 222) is located on the extended line of the second fixing portion 21. An opening of the second recess 23 is defined between the end of the third flat part 223 and the contact portion 24.

The second recess 23 is formed substantially in a C-shape with the first to third flat parts 221 to 223. An inner surface of the first recess 13 is defined by inner surfaces of the first to third flat parts 221 to 223. Among the first to third flat parts 221 to 223, the second flat part 222 is farthest from the opening of the second recess 23. A part of the second recess 23 along the second flat part 222 is defined as an innermost part 231 of the second recess 23.

In addition to an inner surface along the second flat part 222, the innermost part 231 may include curve parts continuous with inner surfaces of the first and third flat parts 221 and 223.

An outer circumferential surface of the held portion 22, which includes two corners 224 and the like, is rounded to a certain level to form a smooth and continuous outer surface of each of the flat parts. In the outer circumferential surface of the held portion 22, the outer surface of the second flat part 222 is provided as an inclined surface 225 according to the inclination of the second flat part 222.

Relationship Between First Member and Second Member

Figure 4:
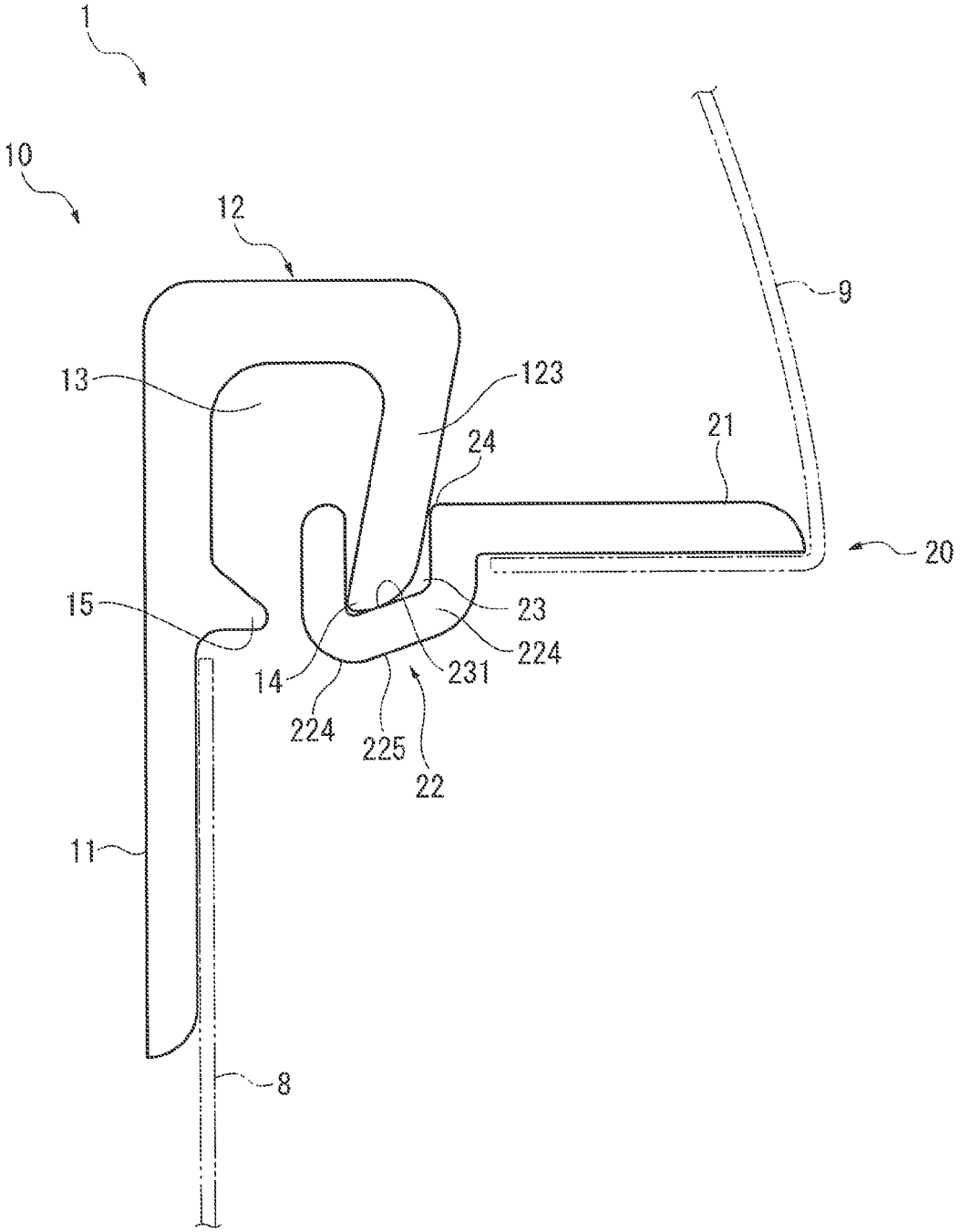
FIG. 4 is an end elevation showing a temporary holding state according to the above exemplary embodiment.

As shown in FIG. 4, the contact portion 24 and the support portion 14 are configured such that the contact portion 24 is brought into contact with a lateral surface of the support portion 14 (a lateral surface of the holder 12 also serving as the support portion 14) and the tip end of the support portion 14 is brought into contact with the innermost part 231 of the second recess 23 when the support portion 14 is inserted into the second recess 23.

Figure 7:
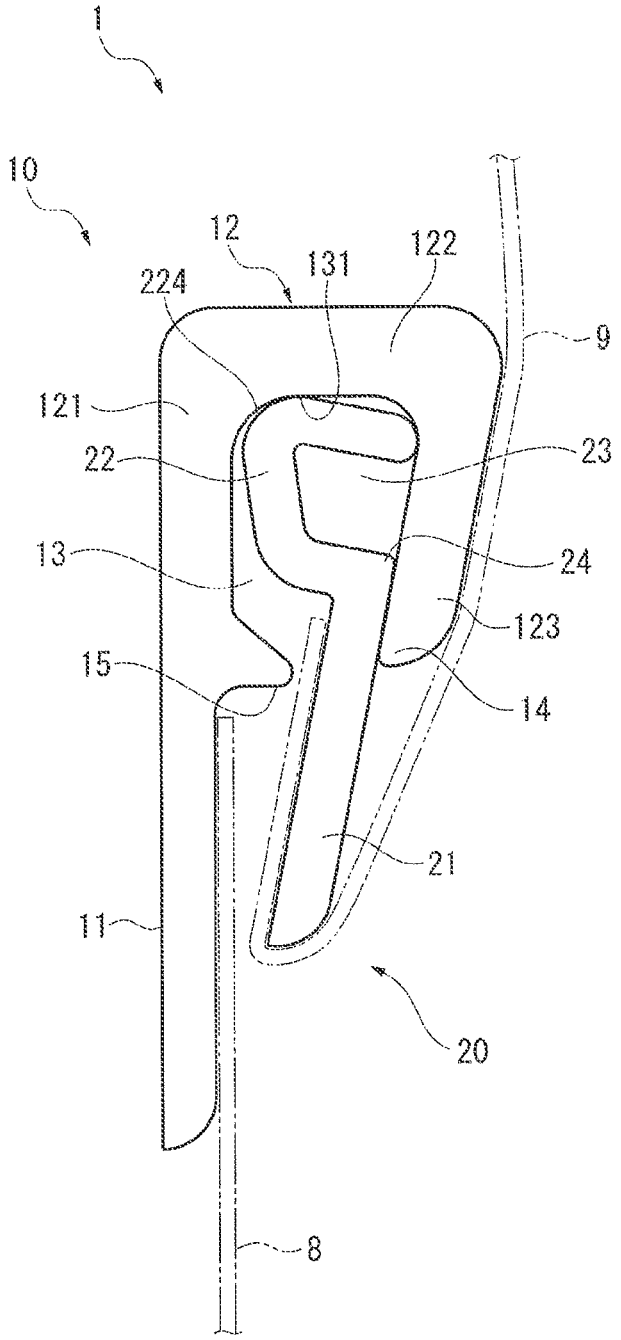
FIG. 7 is an end elevation showing a full holding state according to the above exemplary embodiment.
Figure 8:
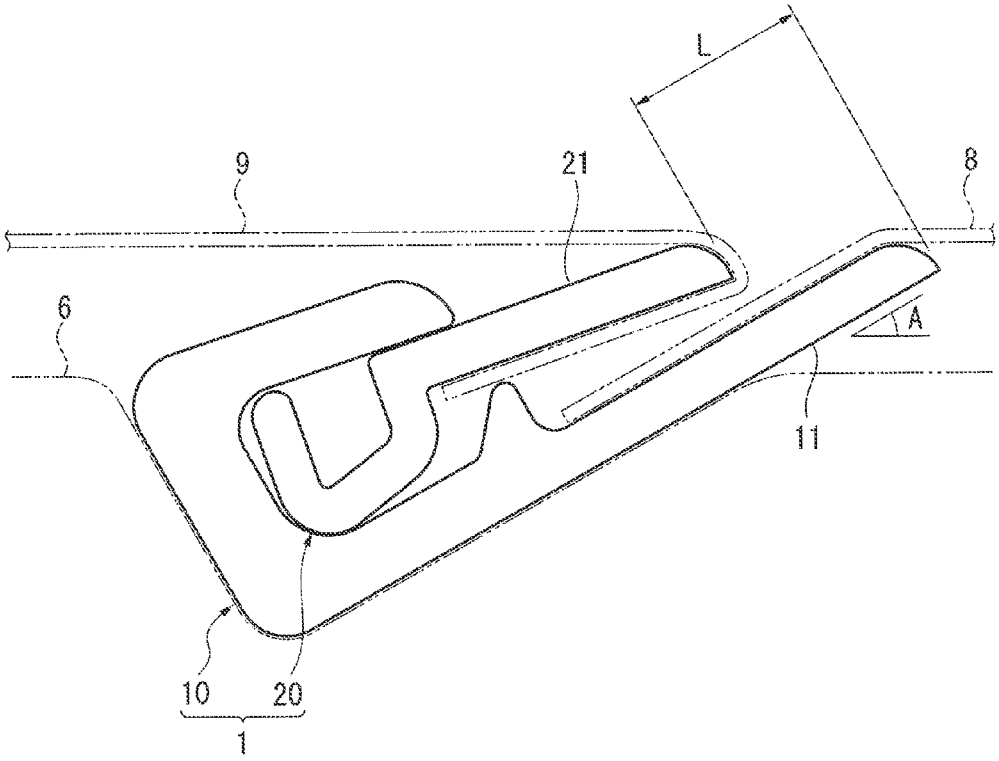
FIG. 8 is an end elevation schematically showing a use state according to the above exemplary embodiment.

As shown in FIG. 7, the contact portion 14 and the held portion 22 are configured such that the contact portion 14 is brought into contact with a surface of the second fixing portion 21 and the held portion 22 is brought into contact with the innermost part 131 of the first recess 13 when the held portion 22 is inserted into the first recess 13.

As shown in FIGS. 2 and 3, in the first member 10, the gap T1 between the projection 15 and the support portion 14 that defines an opening of the first recess 13 is smaller than a minimum thickness T2 of the held portion 22 in the thickness direction D2 of the second fixing portion 21 of the second member 20 (T2>T1).

With this arrangement, in a full holding state of the first member 10 and the second member 20 (see FIG. 7), the held portion 22 of the second member 20 is housed in the first recess 13 of the first member 10, whereby the held portion 22 cannot pass through the opening of the first recess 13, so that the held portion 22 is kept from being detached from the first recess 13.

In an operation of pressing the held portion 22 into the first recess 13 (see FIGS. 5 and 6), a click feeling is obtainable by deformation and restoration of the held portion 22 passing over the projection 15.

Figure 5:
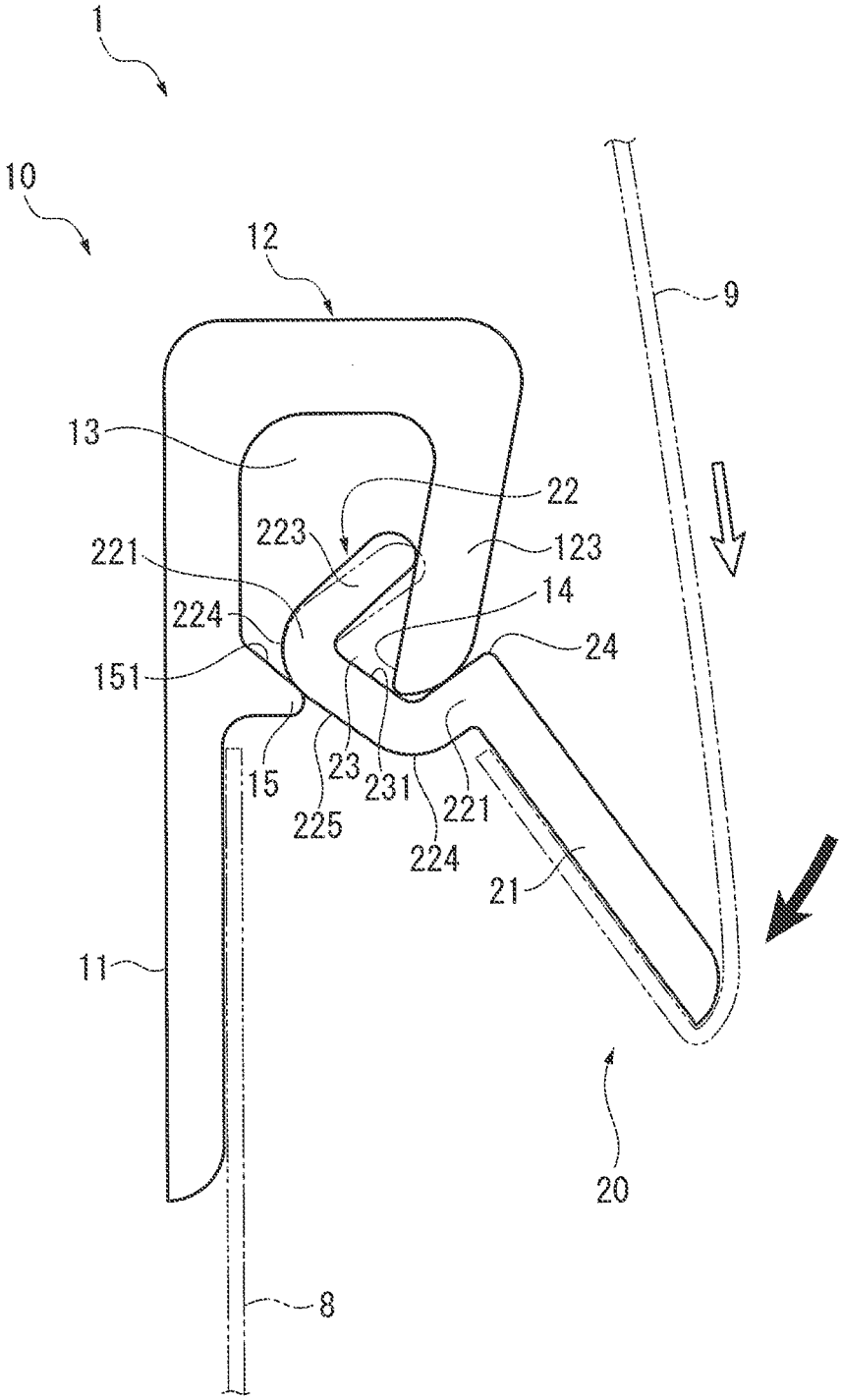
FIG. 5 is an end elevation showing a rotation operation state according to the above exemplary embodiment.

When the held portion 22 is pressed into the first recess 13, as shown in FIG. 5, by bringing the second member 20 close to the first member 10 while rotating the second member 20 around the first member 10, the projection 15 is brought into sliding contact with the corners 224 and the inclined surface 225 defining the outer circumferential surface of the held portion 22.

The inclined surface 225 receives a press force from the projection 15, whereby the end of the third flat part 223 of the held portion 22 is strongly pressed onto the lateral surface of the support portion 14 (the inner surface of the third flat part 123), so that the support portion 14 is held as long as possible in a space surrounded by the inner surfaces of the second recess 23 inside the held portion 22.

Although the outer circumferential surface of the held portion 22, including the corners 224, is rounded, the operator who rotates the second member 20 can obtain a clear click feeling when the corners 224 of the held portion 22 pass over the projection 15.

Figure 6:
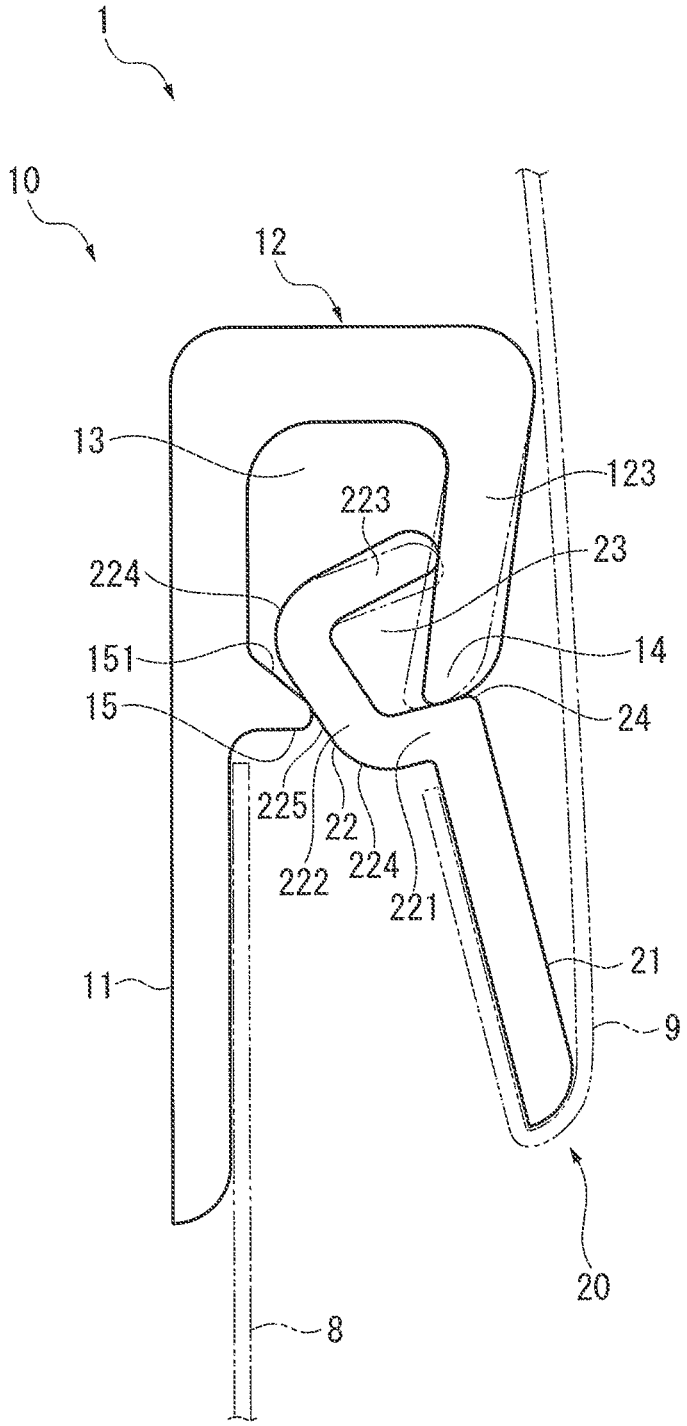
FIG. 6 is an end elevation showing a rotation operation state in progress according to the above exemplary embodiment.

The projection 15 is formed at a connection part between the first fixing portion 11 and the first flat part 121 of the holder 12 including the first recess 13. However, it is only required that the connection part between the holder 12 and the first fixing portion 11 is defined at a position or in a range where the projection 15 can contact with or slide on the outer circumferential surface of the second recess 23 of the second member 20 by the rotation of the second member 20 as shown in FIGS. 5 and 6.

Fastening Procedure

FIGS. 4 to 7 show a fastening procedure of the sheet edges 8 and 9 in the exemplary embodiment.

Firstly, the sheet edge 8 is fixed on a surface of the first fixing portion 11 of the first member 10 on a side at which the projection 15 is formed and the sheet edge 9 is fixed on a surface of the second fixing portion 21 of the second member 20 on a side from which the held portion 22 projects.

In FIG. 4, the held portion 22 of the second member 20 is initially moved closer to the first member 10 and the second member 20 is situated substantially perpendicular to the first member 10. Then, the support portion 14 of the first member 10 is inserted into the second recess 23 of the second member 20. By this operation, the contact portion 24 of the second member 20 is brought into contact with the lateral surface of the support portion 14 of the first member 10 while the tip end of the support portion 14 is brought into contact with the innermost part 231 of the second recess 23. By the contact at two points, the first member 10 and the second member 20 are in mutual engagement (a temporary holding state between the first member 10 and the second member 20).

In this state, the sheet edge 9 is positioned such that a side of the sheet edge 9 fixed on the second fixing portion 21 is opposite to a side thereof near the most part of the sheet, and is held while being bent by the tip end of the second fixing portion 21.

After the first member 10 and the second member 20 in whole length are brought into the temporary holding state, creases, sags and the like of the sheet edges 8 and 9 are removed in the temporary holding state. After the removal, the second member 20 is rotated around the support portion 14 so that the sheet edge 9 is remote from the most part of the sheet, thereby feeding the held portion 22 into the first recess 13, while the second fixing portion is rotated to wind the sheet edge therearound.

As shown in FIG. 5, by keeping the rotation of the second member 20, tension is applied on the sheet edge 9 and the second member 20 becomes more parallel to the first member 10.

As shown in FIG. 6, the projection 15 of the first member 10 is brought into slide contact with the inclined surface 225 formed on the outer circumferential surface of the second recess 23 of the second member 20, and the end of the held portion 22 (the end of the third flat part 223) is pressed onto the inner surface of the holder 12 (the inner surface of the third flat part 123), thereby keeping the contact portion 24 in contact with the inner surface of the second recess 23. By this operation, the second member 20 is rotated without being detached from the first member 10.

During the rotation of the second member 20, the support portion 14 moves out of the second recess 23 and the held portion 22 is inserted into the first recess 13.

As shown in FIG. 7, as a result of the rotation of the second member 20, the contact portion 14 is finally brought into contact with the surface of the second fixing portion 21 while the held portion 22 is brought into contact with the innermost part 131 of the first recess 13. By the contact at two points, the first member 10 and the second member 20 are in mutual engagement (a full holding state between the first member 10 and the second member 20).

In this state, the tension of the sheet edge 9 works in a manner to press the held portion 22 onto the innermost part 131 of the first recess 13. By this contact between the held portion 22 and the innermost part 131 of the first recess 13, the first member 10 and the second member 20 are restricted from moving in the tension direction. Moreover, since the moment generated on the second member 20 by the tension works in the direction in which the support portion 14 is brought into contact with the surface of the second fixing portion 21 (opposite to the surface on which the sheet edge 9 is fixed), the contact between the support portion 14 and the surface of the second fixing portion 21 restricts the second member 20 from rotating relative to the first member 10, thereby maintaining a mutually stable connection.

Accordingly, the first member 10 and the second member 20 are reliably connected, so that the sheet edges 8 and 9 are fastened while being close to each other.

In the full holding state, the held portion 22 is brought into dedicated contact with the innermost part 131 of the first recess 13. However, the corner 224 of the held portion 22 (a continuous part between the second and third flat parts 222 and 223) may be brought into contact with an arc part of a continuous part between the first and second flat parts 121 and 122 on the inner surface of the first recess 13. Even with a large moment generated on the second member 20 by the tension of the sheet edge 9, the full holding state can be sufficiently kept.

Advantages of Exemplary Embodiment(s)

According to the exemplary embodiment, when the first member 10 and the second member 20 are connected, the first member 10 and the second member 20 can be held in the temporary holding state and the full holding state. When the sheet edges 8 and 9 are neatly arranged for mutual fastening before the temporary holding state and the tension is applied on the sheet edges 8 and 9 in a process from the temporary holding state before the full holding state, a requisite tension enough to fasten the sheet 7 is obtainable while the tension is applicable on the neatly arranged sheet 7.

Since the tension is applied using the rotation of the second member 20, the operator does not need an operation such as twisting of his wrist, so that an efficient operation is possible. Moreover, since the first member 10 and the second member 20 are brought into the temporary holding state before the tension is applied, there is enough time to neatly arrange the sheet 7 along the whole length of the sheet edges 8 and 9. In other words, after the first member 10 and the second member 20 are initially brought into the temporary holding state along the whole length of the sheet edges 8 and 9 and the whole sheet 7 are neatly arranged, the second member 20 is rotated along the whole length of sheet edges 8 and 9, whereby the first member 10 and the second member 20 can be brought into the full holding state.

By this operation, the tension required for the sheet 7 and the sheet edges 8 and 9 can be ensured and an operational efficiency for fastening can be improved.

When fastening of the sheet edges 8 and 9 is completed, the first member 10 and the second member 20 are half-buried in the cushion material 6 while the respective sides of the first member 10 and the second member 20 near and on the first fixing portion 11 and the second fixing portion 21 on which the sheet edges 8 and 9 are fixed are raised.

In the exemplary embodiment, in the engagement between the first member 10 and the second member 20, the first fixing portion 11 is formed to project beyond the second fixing portion 21 by a length L. With this arrangement, the tension of the sheet edge 8 applied on the longer first fixing portion 11 suppresses the first member 10 and the second member 20 from rising. For instance, an angle A of the cushion material relative to a reference surface is kept at about 35 degrees.

Modifications

The invention is not limited to the above-described embodiment but modifications and the like are included in the scope of the invention as long as an object of the invention is attained.

In the above exemplary embodiment, in the full holding state, the support portion 14 is brought into contact with the surface of the second fixing portion 21 while the held portion 22 is brought into contact with the inner surface of the first recess 13. By the contact at the plural points (two points), the first member 10 and the second member 20 are in mutual engagement. However, even in the full holding state, the projection 15 on the first recess 13 may be in contact with the outer surface of the second fixing portion 21, whereby the engagement between the first member 10 and the second member 20 can be further reinforced. For this arrangement, the projection 15 may be brought into contact with the outer surface of the second fixing portion 21 through the surface of the sheet edge 9 fixed on the outer surface of the second fixing portion 21.

In the above exemplary embodiment, in the full holding state, when the support portion 14 is in contact with the surface of the second fixing portion 21 while the held portion 22 is in contact with the inner surface of the first flat part 121, a strong pressing force is applied on the two contact portions by the moment generated on the second member 20 by the tension of the sheet edge 9. When a sufficient friction force at each of the contact portions is obtained by this pressing force, the tension of the sheet edge 9 can also be sufficiently resisted only with the friction force.

When the tension of the sheet edge 9 is strong, even without contact between the held portion 22 and the innermost part 131 of the first recess 13, the first member 10 and the second member 20 can be mutually engaged only by the contact between the support portion 14 and the surface of the second fixing portion 21.

As described above, even in the engagement between the first member 10 and the second member 20 without the contact between the held portion 22 and the innermost part 131 of the first recess 13, by bringing the projection 15 on the first recess 13 into contact with the outer surface of the second fixing portion 21, or by bringing the projection 15 into contact with the sheet edge 9 fixed on the outer surface of the second fixing portion 21, the outer surface of the second fixing portion 21 can be more firmly engaged.

When the tension applied on the top cover is weak, the first member 10 and the second member 20 are occasionally engageable providing that the support portion 14 is in contact with the surface of the second fixing portion 21.

In the above exemplary embodiment, the holder 12 and the held portion 22 are formed in a U-shape or a C-shape having corners. However, the holder 12 and the held portion 22 may be provided by a more rounded member. The shape of the projection 15 is not limited to a shape projecting from the first fixing portion 11, but the projection 15 may be provided by curving the first fixing portion 11.

Figure 9:
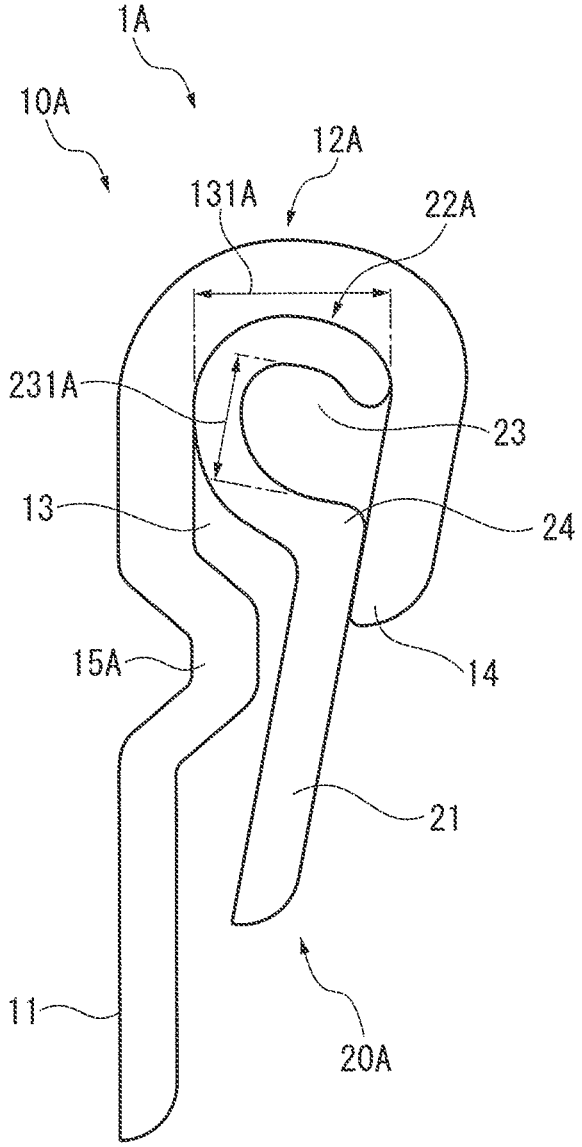
FIG. 9 shows another exemplary embodiment of the invention.

In another exemplary embodiment shown in FIG. 9, a sheet fastener 1A includes a first member 10A and a second member 20A. The first member 10A includes a U-shaped holder 12A having a cylindrical bottom. A held portion 22A of the second member 20A is formed in a C-shape corresponding to an inner surface of the holder 12A. In the first member 10A, a projection 15A is provided by curving the first fixing portion 11 and projects toward the support portion 14.

In the exemplary embodiment, an innermost part 131A is provided by a curved surface that is located at the innermost from the opening of the first recess 13 (the upper side of the figure). An innermost part 231A is provided by a curved surface that is located at the innermost from the opening of the second recess 23 (the left side of the figure).

This exemplary embodiment shown in FIG. 9 can also provide the same advantages as those of the exemplary embodiment shown in FIGS. 1 to 8.

In the above exemplary embodiment, the holder 12 of the first member 10 is formed substantially in a U-shape and extends only toward the first fixing portion 11. However, the holder 12 may also include a portion and the like which project in a direction opposite to the first fixing portion 11. In the second member, the held portion 22 and the second fixing portion 21 are continuous with each other at the lateral side of the second recess 23 near the opening, however, may be continuous with each other at another portion.

Figure 10:
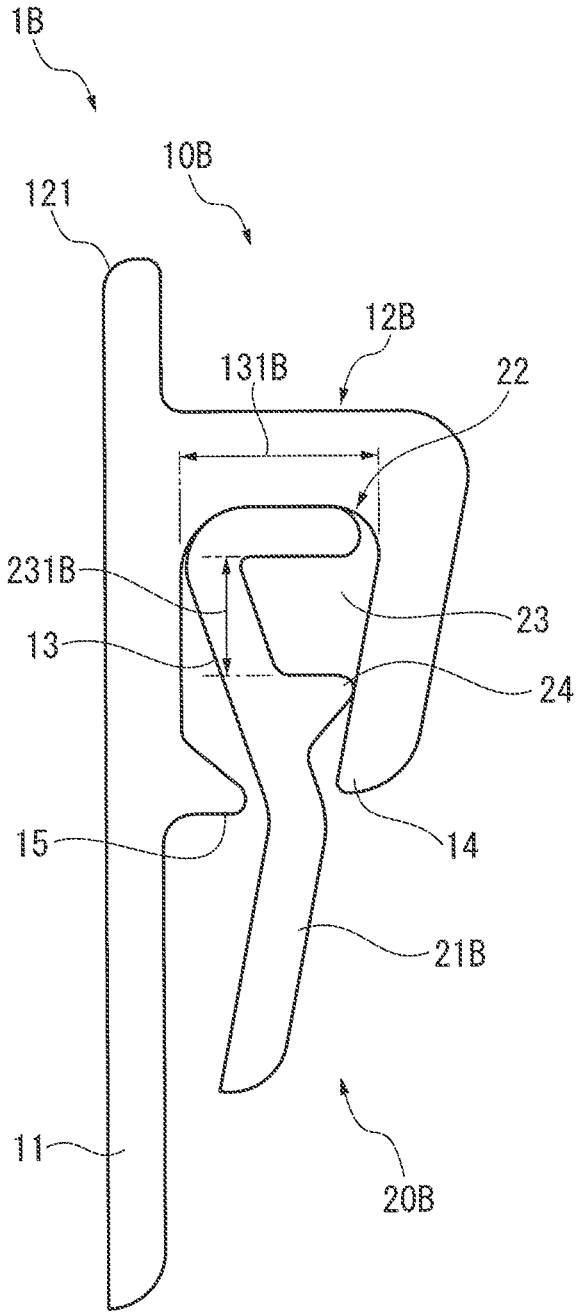
FIG. 10 shows still another exemplary embodiment of the invention.

In still another exemplary embodiment shown in FIG. 10, a sheet fastener 1B includes a first member 10B and a second member 20B. The first member 10B includes an h-shaped holder 12B. The flat part 121 further extends beyond the holder 12B toward a side opposite to the side continuous with the first fixing portion 11. In a second member 20B, the held portion 22 is formed in the same shape as in the aforementioned exemplary embodiment in FIGS. 1 to 8, however, a second fixing portion 21B is partially bent and a part thereof continuous with the held portion 22 is closer to the bottom of the second recess 23.

In the exemplary embodiment, an innermost part 131B is provided by a combination of a flat surface at the innermost from the opening of the first recess 13 (the upper side of the figure) and a curved surface continuous with lateral surfaces on both sides of the flat surface. An innermost part 231A is provided by a combination of a flat surface at the innermost from the opening of the second recess 23 (the left side of the figure) and a curved surface continuous with lateral surfaces on both sides of the flat surface.

This exemplary embodiment shown in FIG. 10 can also provide the same advantages as those of the exemplary embodiment shown in FIGS. 1 to 8.

In the above exemplary embodiments, the second members 20, 20A and 20B including the held portion 22 or 22A (head) formed with the second recess 23 shaped in a bag are employed. In contrast, a T-shaped or L-shaped second member 20C having a flat head may be employed.

Figure 11:
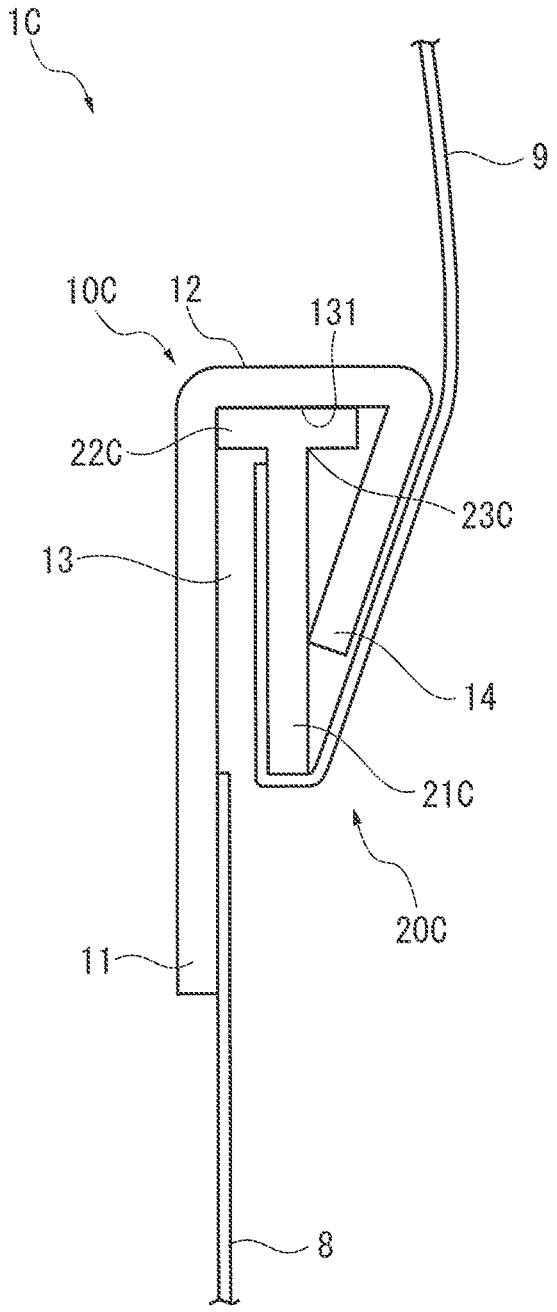
FIG. 11 shows a further exemplary embodiment of the invention.
Figure 12:
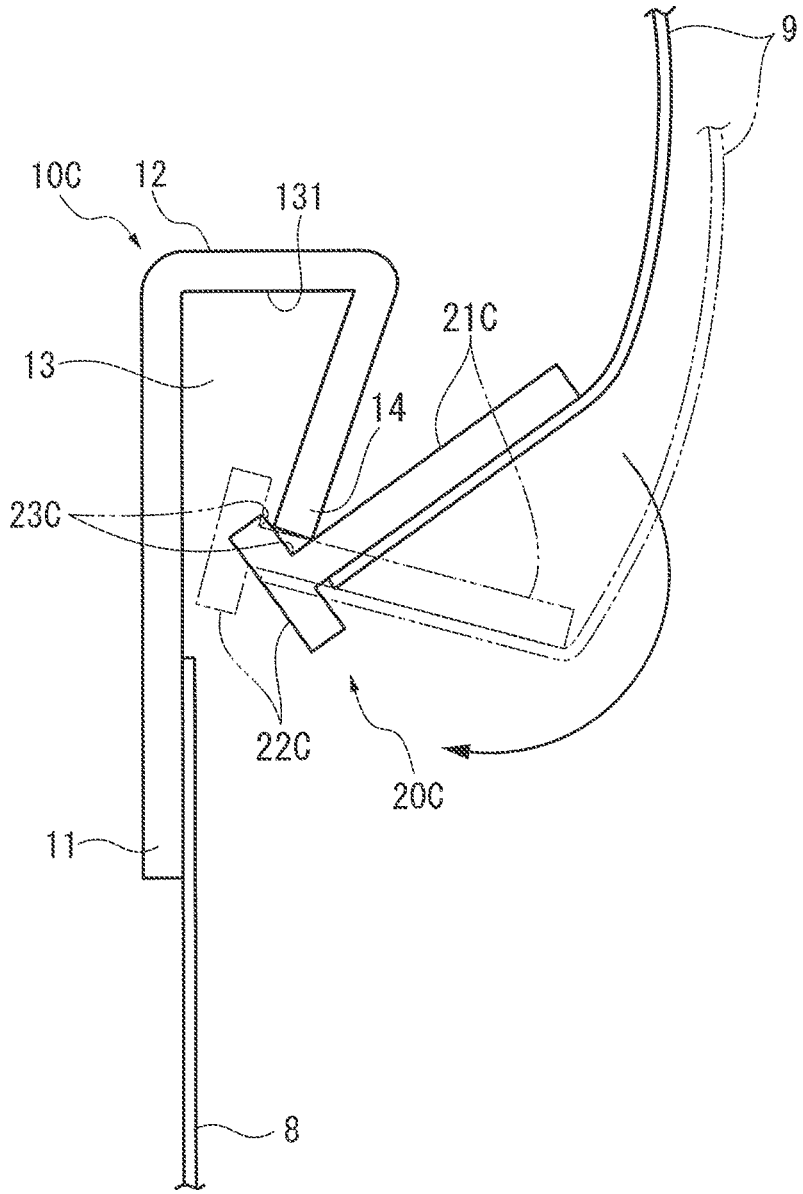
FIG. 12 is an end elevation showing an operation according to the above exemplary embodiment in FIG. 11.

FIGS. 11 and 12 show a further exemplary embodiment of the invention.

In FIG. 11, in the same manner as the first member 10 in the first exemplary embodiment, a first member 10C includes the first fixing portion 11, holder 12, first recess 13 and support portion 14, in which the sheet edge 8 is fixed to the first fixing portion 11. However, the projection 15 as in the first exemplary embodiment is not formed on the first member 10C.

A second member 20C includes a first fixing portion 21C to which the sheet edge 9 is fixed, and a held portion 22C (head) connected at a right angle to a tip end of the first fixing portion 21C. Thus, the second member 20C is formed in a T-shape as a whole. Moreover, the second member 20C includes a second recess 23C defined by an internal corner at a connection part of the first fixing portion 21C and the held portion 22C.

It should be noted that the held portion 22C only needs to be formed at a side to form an internal corner as the second recess 23C. In this arrangement, the second member 20C is formed in an L-shape as a whole.

In this arrangement, as shown by a solid line in FIG. 12, when the second recess 23C of the second member 20C is engaged with the support portion 14 of the first member 10, a temporary holding state can be established.

As shown by a chain line in FIG. 12, when the second member 20C is rotated to insert the held portion 22C into the first recess 13, whereby the held portion 22C is brought into contact with the innermost part 131, a full holding state can be established.

This exemplary embodiment shown in FIG. 10 can also provide the same advantages as those of the exemplary embodiment shown in FIGS. 1 to 8.

In the above exemplary embodiments, examples of fastening sheet edges of a backrest of a vehicle seat are described. However, the invention is not limited to the examples. The invention is applicable to any sheet for other parts of the seat. Further, the invention is applicable to, in addition to a seat of a vehicle such as an automobile and a train, a seat of an airplane and a ship, a cushion of sports gears, and furniture such as a sofa and a bed for residence. Moreover, in addition to the top cover such as the seat and the cushion, the invention is applicable for fastening sheet edges of a structural object such as a tent, fastening cover edges of a package during transportation, and the like.

The invention claimed is:

1. A sheet fastener for fastening a pair of sheet edges continuously along the sheet edges, comprising:

a first member; and a second member capable of being inserted into the first member, each of the first member and the second member being provided by a continuous member having a predetermined cross section, wherein the first member comprises a first fixing portion and a holder continuous with the first fixing portion, wherein the first fixing portion is capable of fixing one of the sheet edges, the holder comprises a first recess and a support portion formed opposite the first fixing portion across an opening of the first recess, the second member comprises a second fixing portion, a head continuous with the second fixing portion, and a second recess that is defined by the head and includes an opening engageable with the support portion, wherein the second fixing portion is capable of fixing the other one of the sheet edges, the second member comprises a contact portion formed along an opening edge of the head near the second fixing portion, wherein in a first state where the support portion is inserted into the head:

the contact portion and the support portion are configured such that the contact portion contacts a lateral surface of the support portion and a tip end of the support portion contacts an inner surface of the head, and wherein in a second state where the head is inserted in the first recess:

the support portion is configured to contact a surface of the second fixing portion.

2. The sheet fastener according to claim 1, wherein in the second state, the support portion and the head are configured such that the support portion contacts the surface of the second fixing portion and the head contacts an inner surface of the first recess.

3. The sheet fastener according to claim 1, wherein the first member comprises a projection that projects toward the support portion.

4. The sheet fastener according to claim 3, wherein the projection projects from a connection part between the holder and the first fixing portion toward the support portion, and a gap between the projection and the support portion is defined to be smaller than a minimum thickness of the head of the second fixing portion in a thickness direction.

* * * * *

UNITED STATES PATENT AND TRADEMARK OFFICE

CERTIFICATE OF CORRECTION

PATENT NO. : 9,161,635 B2
APPLICATION NO. : 14/348928
DATED : October 20, 2015
INVENTOR(S) : Yoshito Toribuchi et al.

It is certified that error appears in the above-identified patent and that said Letters Patent is hereby corrected as shown below:

In the specification

In column 6, line 13, delete "such the" and insert -- such that the --, therefor.

Signed and Sealed this
Eighth Day of March, 2016

Michelle K. Lee

Michelle K. Lee
*Director of the United States Patent and Trademark Office*